US009925410B2

(12) United States Patent
Duffy

(10) Patent No.: US 9,925,410 B2
(45) Date of Patent: Mar. 27, 2018

(54) EXERCISE WEDGE

(71) Applicant: James S Duffy, Bedford, NY (US)

(72) Inventor: James S Duffy, Bedford, NY (US)

( * ) Notice: Subject to any disclaimer, the term of this patent is extended or adjusted under 35 U.S.C. 154(b) by 0 days.

(21) Appl. No.: 15/274,824

(22) Filed: Sep. 23, 2016

(65) Prior Publication Data

US 2017/0087406 A1 Mar. 30, 2017

Related U.S. Application Data

(60) Provisional application No. 62/222,961, filed on Sep. 24, 2015.

(51) Int. Cl.

| | |
|---|---|
| ***A63B 23/04*** | (2006.01) |
| ***A63B 21/04*** | (2006.01) |
| ***A63B 21/00*** | (2006.01) |
| ***A63B 21/068*** | (2006.01) |
| *A63B 21/055* | (2006.01) |
| *A63B 23/035* | (2006.01) |
| *A63B 23/12* | (2006.01) |
| *A63B 21/062* | (2006.01) |

(52) U.S. Cl.

CPC ..... *A63B 21/4035* (2015.10); *A63B 21/0442* (2013.01); *A63B 21/068* (2013.01); *A63B 21/4034* (2015.10); *A63B 23/0405* (2013.01); *A63B 21/00061* (2013.01); *A63B 21/0552* (2013.01); *A63B 21/0628* (2015.10); *A63B 23/03525* (2013.01); *A63B 23/03575* (2013.01); *A63B 23/1209* (2013.01)

(58) Field of Classification Search

CPC ..... A63B 21/4035; A63B 21/4034; A63B 21/0442; A63B 21/068; A63B 23/0405; A63B 21/0628; A63B 21/00061; A63B 21/0552; A63B 23/03525; A63B 23/03575; A63B 23/1209

USPC ..... 482/121, 130

See application file for complete search history.

(56) References Cited

U.S. PATENT DOCUMENTS 1,538,844 A * 5/1925 Titus ..... A63B 21/0004 482/126
1,980,861 A * 11/1934 Hunter ..... A63B 21/023 482/125
5,127,892 A * 7/1992 Sawdon ..... A63B 23/10 482/79
5,352,176 A * 10/1994 Huang ..... A63B 21/0004 482/123
5,524,893 A * 6/1996 McGinnis ..... A63B 21/04 473/229
6,042,523 A * 3/2000 Graham ..... A63B 21/0552 482/121

(Continued)

*Primary Examiner* — Andrew S Lo
(74) *Attorney, Agent, or Firm* — Michael J. Brown

(57) ABSTRACT

A portable exercise device designed to efficiently and safely target and isolate the gluteal, hamstring and calf muscles, which are the posterior muscles of the lower body, while limiting the use and over training of the quadriceps (thigh) anterior muscles of the lower body. The exercise device is an inclined platform with an additional raised support, providing resistance originating from within the platform, which optimizes the eccentric phase of every squat and lunge for maximal strength and hypertrophy of the muscles. The combination of the inclined platform with additional raised support places the user into an optimal position for exercising the posterior muscles of the lower body.

10 Claims, 6 Drawing Sheets

(56) References Cited

U.S. PATENT DOCUMENTS 7,410,450 B1 * 8/2008 Paulding ..... A63B 21/0552 482/120
7,431,681 B1 * 10/2008 St Cyr ..... A63B 21/0552 482/121
8,062,189 B1 * 11/2011 Moring, Jr. ..... A63B 21/00047 482/142
2006/0046911 A1 * 3/2006 Leight ..... A63B 21/025 482/91
2006/0128539 A1 * 6/2006 Marquez ..... A63B 21/4035 482/123
2006/0128540 A1 * 6/2006 Engle ..... A63B 21/04 482/123
2007/0129226 A1 * 6/2007 Leavitt ..... A63B 23/0458 482/129
2009/0192022 A1 * 7/2009 Kulka ..... A63B 21/153 482/46
2010/0255966 A1 * 10/2010 Aucamp ..... A63B 21/0552 482/131
2011/0124473 A1 * 5/2011 Kole ..... A63B 21/028 482/79
2011/0251033 A1 * 10/2011 Blancher ..... A63B 21/0442 482/123
2012/0115692 A1 * 5/2012 Bussen ..... A63B 21/0442 482/130
2012/0184412 A1 * 7/2012 Glaner ..... A63B 69/18 482/30
2013/0090216 A1 * 4/2013 Jackson ..... A63B 21/018 482/52
2014/0087927 A1 * 3/2014 Richard ..... A63B 71/0036 482/123
2014/0128230 A1 * 5/2014 Burcham ..... A63B 21/00185 482/123
2015/0190679 A1 * 7/2015 Carbone ..... A63B 26/003 482/146
2016/0175654 A1 * 6/2016 Harwin ..... A63B 26/003 482/142
2016/0193490 A1 * 7/2016 Chen ..... A63B 21/00061 482/126

* cited by examiner

EXERCISE WEDGE

FIELD OF INVENTION

The invention is in the field of exercise equipment, specifically portable exercise equipment that can be used at home or at a gym.

BACKGROUND

Exercising the gluteal and hamstring muscles correctly and efficiently is difficult and may put strain on the exerciser's knees and back, causing injuries. It is also difficult, if not impossible, to target these muscles without also working out the front of the thighs, which many people do not want to do.

Squats and lunges are two main exercises prescribed to best work out and develop the gluteal and hamstring muscles. Many people cannot perform squats or lunges because of back and knee issues. Squats and lunges are difficult exercises and without proper supervision can cause great harm to knees and backs, especially when using free weights. Proper form is difficult but essential to performing squats and lunges safe and effectively. When doing squats even when supervised it is difficult to keep your body in the proper position and form to be safe and effective. Further, these exercises will always build up quadricep muscles equally with the gluteal and hamstring muscles, if not more at the same time. Many women in particular prefer not to over build their quadriceps but still want to work on their gluteal and hamstring muscles.

When doing squats and lunges, many people let their knees extend forward beyond their toes, which is dangerous for the knees. Professional trainers often provide two points of advice: (a) keep your weight on your heels and (b) don't extend your knees past your toes. People often perform squats and lunges with bar bells or free weights to add more resistance than just their body weight. If not done right the exercises can cause harm to your knees and back.

There is no portable exercise device with built in resistance that is safe and effective, and targeting and isolating the gluteal, hamstring and calf muscles, while removing much of the stress from the knees and back.

SUMMARY OF THE INVENTION

The present invention is a portable exercise device designed to efficiently and safely target and isolate the gluteal, hamstring and calf muscles, which are the posterior muscles of the lower body, while limiting the use and over training of the quadriceps (thigh) anterior muscles of the lower body. The invention is comprised of an inclined platform with an additional inclined support on its surface, the platform providing resistance extending from within the platform, in front of the user and centrally located with respect to the user's body. This resistance optimizes and enhances the concentric and eccentric phases of the exercise. The double incline design puts the user's body into an optimal position so more of the resistance for each exercise is exerted on the posterior side of the lower body. This double inclined platform with built in resistance is unique because it places the individual exerciser in the optimal position and form that makes each squat and lunge safer and more effective to shape, lift and firm the gluteal muscles while limiting the use of the quadricep muscles. It does this without putting the stresses on the knees and back that are usually associated with performing squats and lunges.

The double wedge design and utility puts the user's body in the optimal position to do squats and lunges to obtain optimal muscle exhaustion and build on the posterior side of the leg, targeting the hamstring and gluteal muscles, while putting less stress and exhaustion on the quadricep muscles which are on the anterior side of the leg.

DETAILED DESCRIPTION OF THE PREFERRED EMBODIMENT

Figure 1:
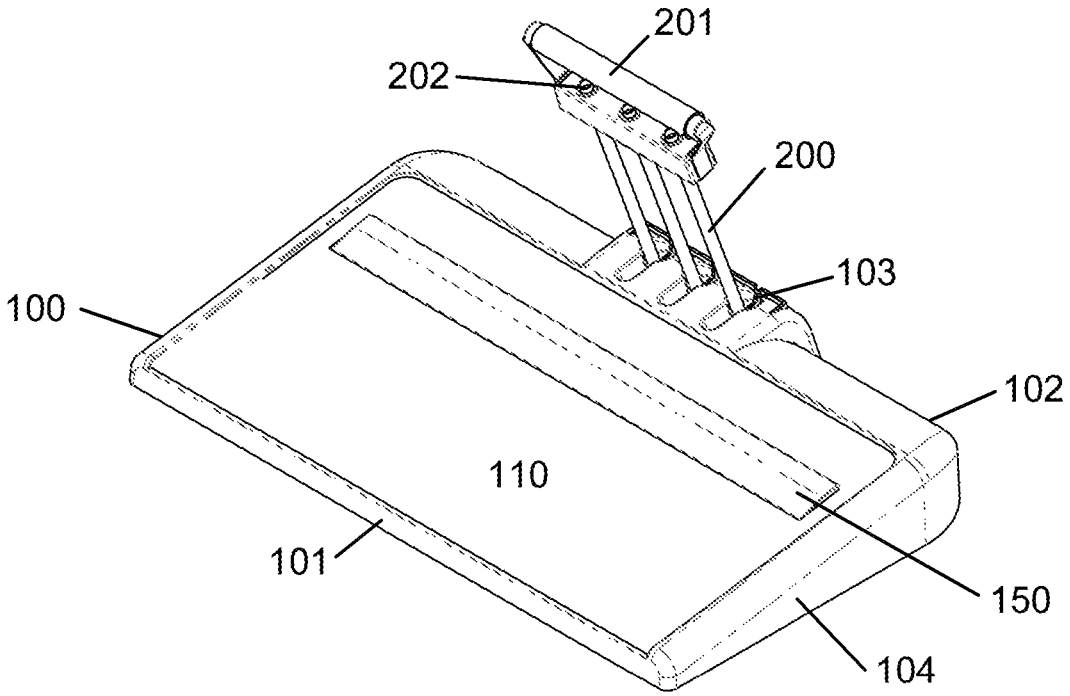
FIG. 1 is a top perspective view of the preferred embodiment of the present invention.
Figure 2:
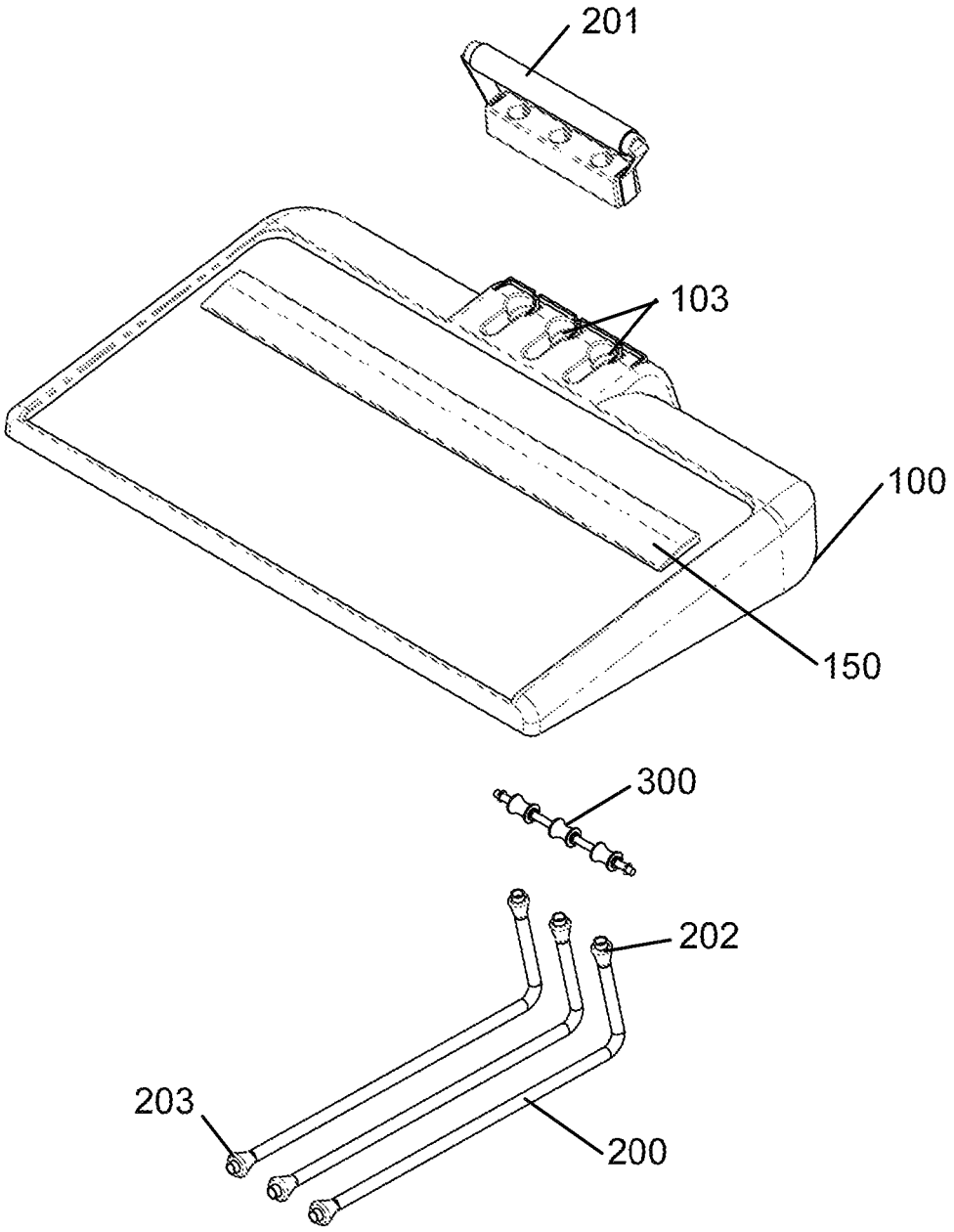
FIG. 2 is an exploded top perspective view thereof.
Figure 3:
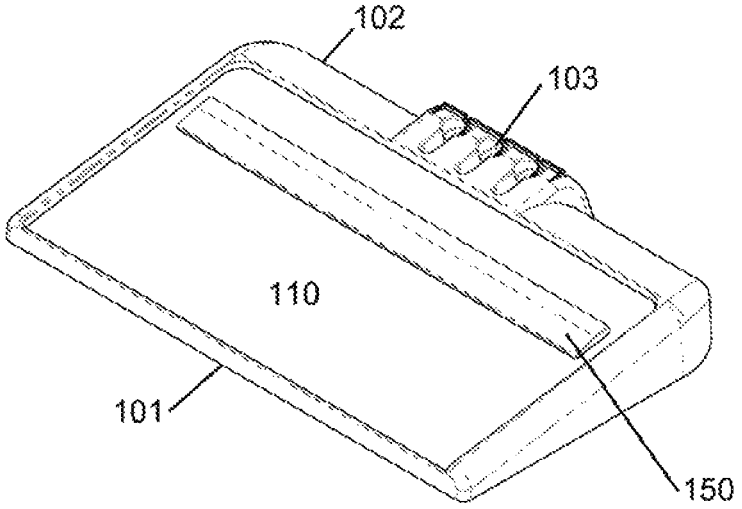
FIG. 3 is a top perspective view of the base of a preferred embodiment of the invention.
Figure 4:
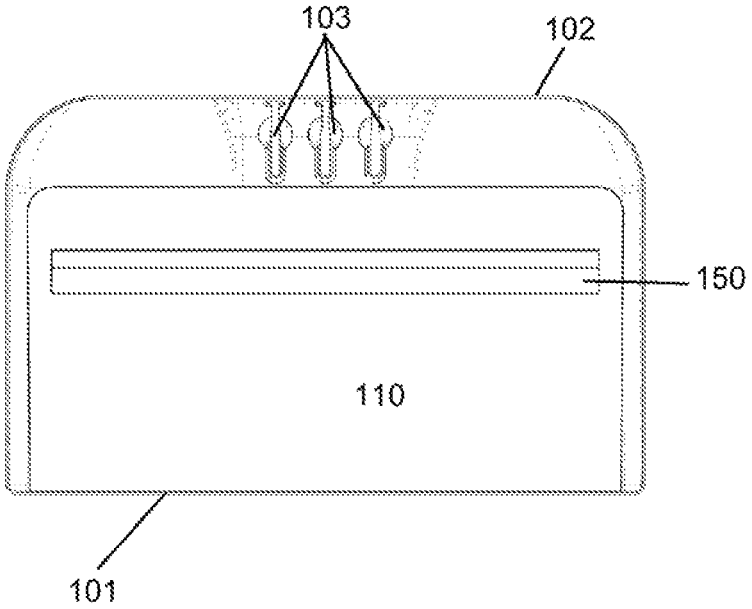
FIG. 4 is a top plan view thereof.
Figure 5:
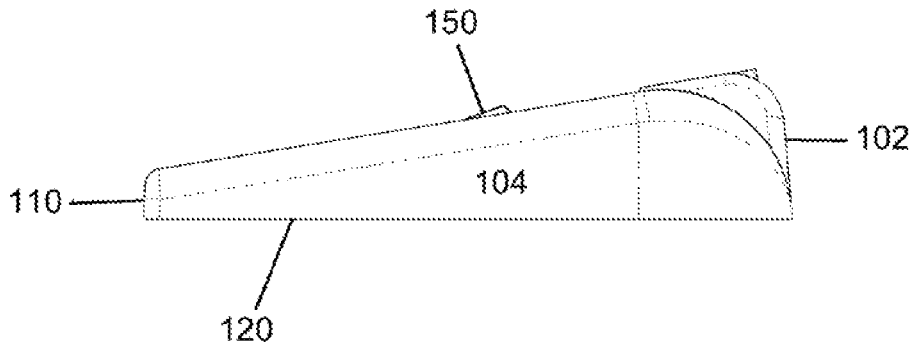
FIG. 5 is right elevational view thereof, the left elevational view being a mirror image.
Figure 6:
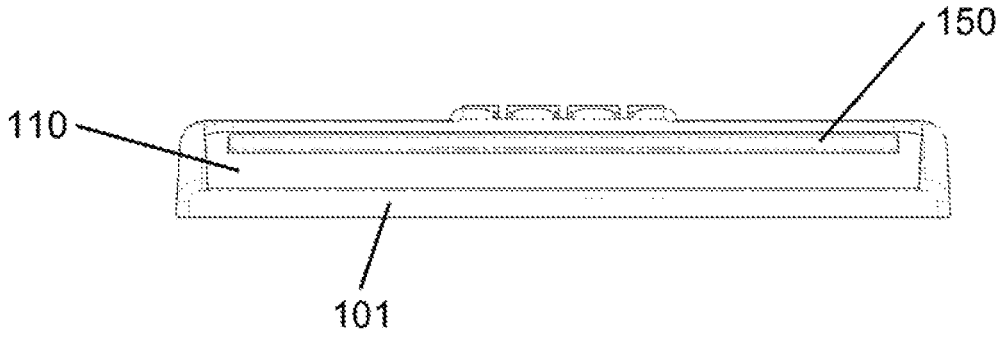
FIG. 6 is a front elevational view thereof.
Figure 7:
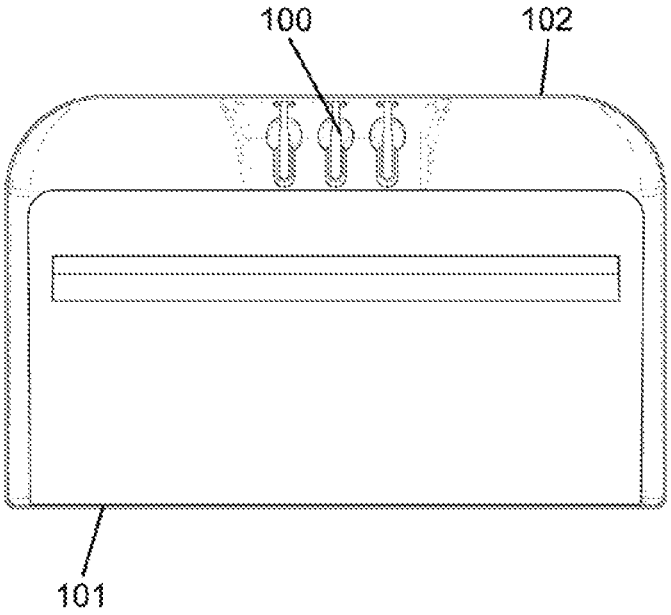
FIG. 7 is a top plan view thereof.
Figure 8:
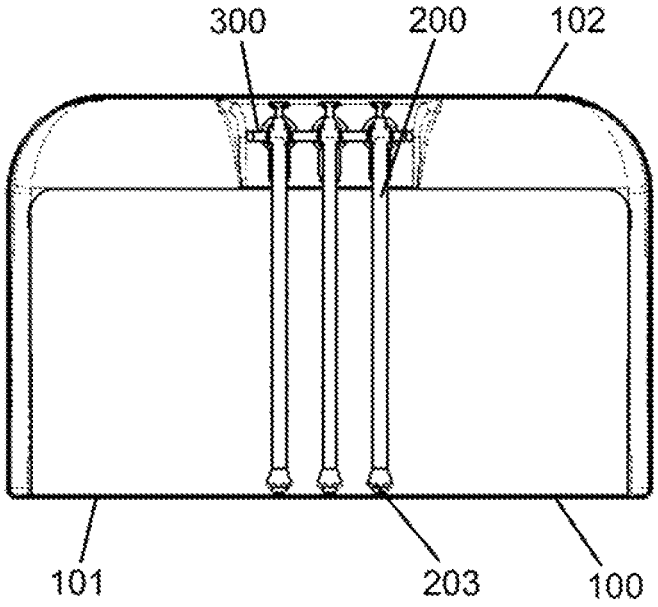
FIG. 8 is a bottom plan view of the preferred embodiment of the invention.
Figure 9:
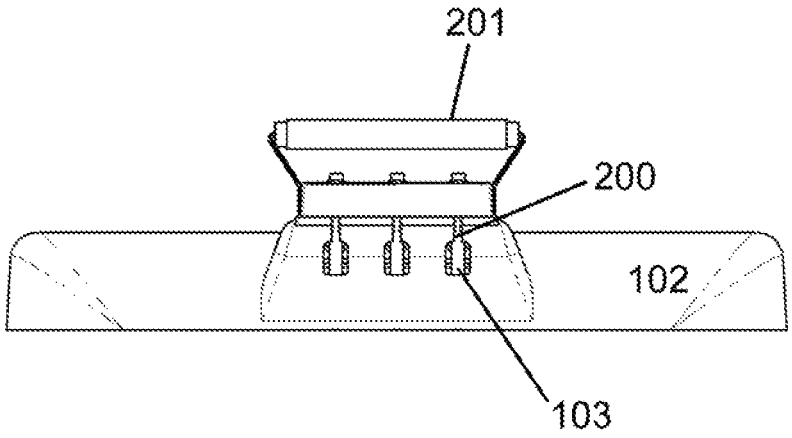
FIG. 9 is a rear perspective view thereof.

The invention preferably consists of a wedge shaped base 100, with front edge 101, rear panel 102, and sides 104. Base 100 is preferably in the shape of an inclined plane, with an inclined upper surface 110 relative to a flat bottom.

Upper surface 110 is formed between front edge 101, rear panel 102 and sides 104. Bottom 120 of base 100 is preferably open, at least partially, as is discussed below. The height of front edge 101 is shorter than the height of rear panel 102, resulting in upper surface 110 forming an inclined surface extending upward vertically from front edge 101 to the top of rear panel 102. The angle formed between inclined upper surface 110 and bottom 120 is preferably between 5 and 25 degrees.

Opening 103 is located within the plane of upper surface 110, proximate to rear edge 102, and is preferably located equidistant from sides 104. In an alternate embodiment, a plurality of openings 103 may be provided. Opening 103 provides a point of origin for resistance for the user's exercises.

Elongated wedge 150 is located on surface 110, providing an elongated raised support on surface 110, extending between sides 104. Elongated wedge 150 preferably extends vertically from surface 110 between ¼ of an inch to 1½ inches. Elongated wedge 150 is located between front edge 101 and opening 103, and extends between sides 104, approximately parallel to front edge 101. Elongated wedge 150 may be fixed in location, but is preferably capable of being adjusted into a location between front edge 101 and opening 103. Where elongated wedge 150 is capable of movement, it is preferred to maintain a parallel relationship between elongated wedge 150 and front edge 101. Elongated wedge 150 is preferably placed so that the toes or balls of a user's feet may be placed upon elongated wedge 150 to provide additional lift and angle of the user's feet during use of the invention.

Elongated resistance member 200 extends through opening 103. Handle 201 is attached to handle end 202 of elongated resistance member 200. In a preferred embodiment, base end 203 of elongated resistance member 200 is attached to base 100. For home use, elongated resistance member 200 is preferably elastic, providing resistance to extension or pulling. Elongated resistance member 200 may be comprised of rubber or springs. In a preferred embodiment, elongated resistance member 200 may be comprised of a variety of interchangeable rubber or elastic cords of varying resistance, allowing the user to vary or change the resistance.

Handle 201 may be configured in a variety of forms, including a bar for use with one or two hands, a strap, or other types of handles as are known for use with exercise equipment. Where more than one elongated resistance member 200 is used, each elongated resistance member 200 may be connected to a separate handle 201, or they may be connected to a single handle 201, as is shown in FIG. 1.

In a preferred embodiment, pulley 300 is located within base 100 proximate to opening 103, where elongated resistance member 200 feeds around pulley 300, leading to opening 103.

Bottom 120 of base 100 is preferably open, allowing the user access to elongated resistance member 200. In the preferred embodiment, base end 203 of elongated resistance member 200 is removably attached to base 100 proximate to front edge 101, where the user may swap or interchange different elongated resistance members 200 to allow for variation in the exertion needed for a given exercise. It is well known in the art to provide elastic resistance bands and straps of varying resistance for exercise. One embodiment of the present invention provides a notch and tab engagement of base end 203 and base 100, where base end 203 may slide into a notch located in base 100.

Figure 10:
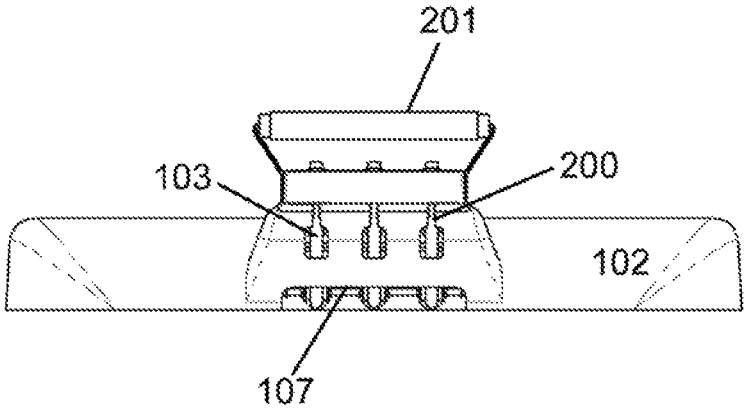
FIG. 10 is a rear perspective view of an alternate embodiment of the present invention.

In an alternate embodiment, base end 203 of elongated resistance member 200 may be connected to an external weight stack for additional weight resistance. In such an alternate embodiment, elongated resistance member 200 is preferably inelastic, relying upon the external weight stack for resistance. Opening 107 may be provided in rear panel 102, as shown in FIG. 10, or may be provided in front edge 101, allowing for base end 203 of elongated resistance member 200 to connect to the external weight stack. In this embodiment where elongated resistance member 200 extends out of opening 107, elongated resistance member 200 passes around pulley 300 in an opposite orientation to the preferred embodiment.

In yet another alternate embodiment, a stabilizer may be attached to base 100 to provide more support for the invention during use. In one embodiment, the stabilizer extends out laterally from bottom 120, and preferably extends outward from front edge 101 or rear panel 102. In a different embodiment, the stabilizer may be moveably attached to base 100, allowing the stabilizer to be stowed away when not needed.

While certain novel features of the present invention have been shown and described, it will be understood that various omissions, substitutions and changes in the forms and details of the device illustrated and in its operation can be made by those skilled in the art without departing from the spirit of the invention.

I claim:

1. An exercise device comprising:

a base with a front edge, rear panel and two side panels, where the rear panel has an upper edge and a lower edge, the upper and lower edges of the rear panel extending between the two side panels of the base, and where a distance between the upper and lower edges creates a height of the rear panel, and where a plane is formed between the front edge, the upper edge of the rear panel and the two side panels, the plane being an inclined surface extending in an upward direction from the front edge to the upper edge of the rear panel;

a raised elongated wedge on the inclined surface, the raised elongated wedge having two ends, each of the ends oriented toward one of the two side panels, where the raised elongated wedge provides a surface extending away from the inclined surface;

where the raised elongated wedge is capable of movement along the inclined surface;

an opening in the inclined surface, the opening located proximate to the rear panel; and an elongated resistance member, the elongated resistance member having a handle end and a base end, the handle end extending through the opening.

2. The exercise device of claim 1, further comprising:

a handle attached to the handle end of the elongated resistance member.

3. The exercise device of claim 1, where the elongated resistance member is comprised of an elastic material.

4. The exercise device of claim 1, where the opening is located between the rear panel and the raised elongated wedge.

5. The exercise device of claim 1, further comprising:

a pulley located within the base proximate to the opening, where the elongated resistance member extends around the pulley.

6. A method of exercising gluteal and hamstring muscles comprising:

providing a floor wedge with an inclined surface and a raised elongated wedge on the inclined surface, where the raised elongated wedge is capable of movement along the inclined surface;

placing feet of a user on the inclined surface, where balls of the user's feet are placed on the raised elongated wedge;

providing an elongated resistance member, the elongated resistance member having a handle end which extends through an opening in the inclined surface in front of the raised elongated wedge, relative to a position of the user, the handle end capable of being held by a user, and the elongated resistance member having a resistance to longitudinal movement; and having the user apply force to the handle end of the elongated resistance member in a direction opposite the resistance to longitudinal movement of the elongated resistance member.

7. The method of claim 6, where the elongated resistance member is elastic.

8. The method of claim 6, where the elongated resistance member has a base end opposite the handle end, the base end being attached to the floor wedge.

9. The method of claim 6, where the elongated resistance member has a base end opposite the handle end, the base end capable of being attached to an external resistance apparatus.

10. An exercise device comprising:

a base with a front edge, rear panel and two side panels, where the rear panel has an upper edge and a lower edge, the upper and lower edges of the rear panel extending between the two side panels of the base, and where a distance between the upper and lower edges creates a height of the rear panel, and where a plane is formed between the front edge, the upper edge of the rear panel and the two side panels, the plane being an inclined surface extending in an upward direction from the front edge to the upper edge of the rear panel;

a raised elongated wedge on the inclined surface, the raised elongated wedge having two ends, each of the ends oriented toward one of the two side panels, where the raised elongated wedge provides a surface extending away from the inclined surface;

an opening in the inclined surface, the opening located proximate to the rear panel;

an elongated resistance member, the elongated resistance member having a handle end and a base end, the handle end extending through the opening;

a rear opening in the rear panel; and where the base end of the elongated resistance member extends through the rear opening, and the base end of the elongated resistance member is capable of attachment to an external resistance apparatus.

* * * * *